US006408572B1

(12) United States Patent
Uchimura et al.

(10) Patent No.: US 6,408,572 B1
(45) Date of Patent: Jun. 25, 2002

(54) DRIVING GEAR

(75) Inventors: Hiroyuki Uchimura; Masayuki Tamura; Nobuo Kobayashi, all of Kiryu (JP)

(73) Assignee: Mitsuba Corporation, Kiryu (JP)

( * ) Notice: Subject to any disclaimer, the term of this patent is extended or adjusted under 35 U.S.C. 154(b) by 0 days.

(21) Appl. No.: 09/585,413

(22) Filed: Jun. 2, 2000

(30) Foreign Application Priority Data

Jun. 3, 1998 (JP) ..... 11-157135
Dec. 28, 1999 (JP) ..... 11-374657
Apr. 24, 2000 (JP) ..... 2000-122556

(51) Int. Cl.[7] ..... E05F 11/48
(52) U.S. Cl. ..... 49/352; 464/92
(58) Field of Search ..... 49/352; 464/55, 464/69, 73, 87, 92, 93, 160; 74/411, 425

(56) References Cited

U.S. PATENT DOCUMENTS 3,884,049 A * 5/1975 Pauli ..... 64/14
4,228,664 A * 10/1980 McCoy ..... 64/14
4,643,040 A * 2/1987 Adam et al. ..... 74/425
4,899,608 A * 2/1990 Knappe et al. ..... 74/411
5,178,026 A * 1/1993 Matsumoto ..... 74/411
5,214,975 A * 6/1993 Zalewski ..... 74/411
5,267,482 A * 12/1993 Yoshida et al. ..... 74/425
5,398,564 A * 3/1995 Yoshida et al. ..... 74/425
5,564,891 A * 10/1996 Iwabuchi et al. ..... 464/73
5,771,744 A * 6/1998 Canova et al. ..... 71/411
6,131,477 A * 10/2000 Gaydek et al. ..... 74/411
6,223,614 B1 * 5/2001 Takiguchi et al. ..... 74/411

* cited by examiner

*Primary Examiner*—Curtis A. Cohen
(74) *Attorney, Agent, or Firm*—Oliff & Berridge PLC

(57) ABSTRACT

A cable driving device for use in a window regulator is made simple in structure and is reduced in weight and size. When a worm wheel 6 to which motor power is transmitted, a damper 8 for absorbing shock, and a drum 7 wound with wires 9 for opening and closing a window glass are assembled into a casing 4 integrally formed with a front bracket 3, damper bodies 8*a*, 8*b* are fitted into cavities 6*d* formed through the worm wheel 6 with a gap S interposed therebetween, and tongues 8*c* extending downwardly from the lower surface of damper 8 are fitted into the gaps S, to form a damper mechanism within the thickness of the worm wheel.

16 Claims, 19 Drawing Sheets

(A)

(B)

(A)

(B)

DRIVING GEAR

BACKGROUND OF THE INVENTION

1. Technical Field

The present invention relates to the technical field of cable driving devices for use in window regulators of automotive vehicles and so on.

2. Description of the Related Art

Generally, cable driving devices of this type, a power window equipped in a vehicle, for example, automatically open and close a window by feeding and winding up cables (wires) wound around a drum (reel) associated with a driving motor by the rotation of the drum to vertically move an actuator coupled to a window glass. Since such a cable driving device is constructed to accommodate in a casing, opposing a worm gear formed at a distal end of a motor shaft, a worm wheel meshed with the worm gear, and a damper mechanism for absorbing shock, and to have a drum wound with a cable and coupled to a protruding distal end of a driving shaft extending outwardly from the bottom of the casing, the cable driving device also requires a casing for accommodating the drum, resulting in a complicated structure having the casings formed both in front of and behind the cable driving device, and an axially extending configuration. In addition, since a power transmission path has a stroke extending in the axial direction, the cable driving device inevitably suffers from a large loss in transmission efficiency. Further, the cable driving device necessarily requires a large number of parts.

On the other hand, as shown in Japanese Unexamined Patent Publication (Kokai) No. Hei 1-182616, a casing (a housing, a gear case), opposing a worm gear formed on a motor shaft (armature shaft), is formed in the shape of a one-side-open closed cylinder, wherein a drum wound with the cables is disposed on the cylinder bottom side of a worm wheel meshed with the worm gear, while a damper for absorbing shock is disposed on the casing opening side of the worm wheel, the casing opening is closed by a cover, and the worm gear is meshed with the casing in which the drum is disposed, thereby accommodating all necessary parts within the single casing.

However, in such a cable driving device, a cable may protrude from the casing and therefore be exposed to water. In addition, since the casing is formed with draw-out openings for drawing the cables, it is difficult to prevent water from entering into the casing. If the entering water further flows into the worm wheel, the water may advance along the worm meshed with the worm wheel to wet a metal-made motor shaft of an electric motor, and to wet the damper interposed between the worm wheel and the cable drum. Then, this situation may cause failures and damage such as oxidization of the motor shaft, resulting in strange sound generated therefrom, deteriorated damper, and so on. It is therefore necessary to provide a water-proof structure for the casing, and smooth drainage for the water which has entered.

For this purpose, as shown in, for example, Japanese Unexamined Patent Publication (Kokai) No. Sho 56-97082 and Japanese Unexamined Utility Model Registration Publication (Kokai) No. Sho 59-35579, attempts have been made to prevent water from entering and reaching a worm wheel by dividing a casing into a section for accommodating a worm wheel and a section for accommodating a cable drum using a water-proof member. Such attempts, however, require partitioning members for water-tight dividing of each section. The former utilizes a rubber partitioning member having a seal lip formed along the outer periphery, while the latter utilizes a partitioning member having an O-ring fitted in the inner periphery. Thus, these attempts result in a problem of an increased number of parts and a complicated structure. In addition, as the cable driving device is driven, the seal lip slides in contact with the inner peripheral surface of the casing in the former structure, while the O-ring slides in contact with the outer periphery of the driving shaft, so that the sliding portions are rubbed to wear, thus giving rise to a problem of impaired durability and reduced efficiency due to the sliding resistance.

To address these drawbacks, as shown in Japanese Utility Model Registration Publication (Kokoku) No. Hei 5-7423, a casing formed with a groove communicating with a drain port (water discharge hole) on a peripheral wall thereof has been proposed to solve the foregoing problem.

However, the structure shown in the aforementioned Japanese Unexamined Patent Publication (Kokai) No. Hei 1-182616 involves assembling the drum with a pair of cables extending from the drum passing through the throughholes formed through the peripheral wall of the casing cylinder, thereby presenting a poor operability. Further, since the worm wheel, the drum and the damper are stacked in a three-layered structure, the resulting cable driving device is thicker in the axial direction, which prevents the resulting device from being compact in size and prevents the device from being incorporated into a thin door. Moreover, since this cable driving device includes the worm wheel which causes the damper and the drum to be spaced by a long distance, problems arise that members required for coupling them result in an increased number of parts, and that a loss in power transmission causes a lower efficiency. Here exist problems to be solved by the present invention.

On the other hand, the structure shown in the aforementioned Japanese Utility Model Registration Publication (Kokoku) No. Hei 5-7423 has an inner cylinder formed inside the peripheral wall of the casing in such a manner that the inner cylinder extends vertically from the bottom of the casing to define a space between the inner peripheral surface of the peripheral wall and the outer peripheral surface of the inner cylinder as a trough groove to guide entering water to the drain port. However, for accommodating a worm wheel meshed with a rotating worm in association with a driven motor on the bottom side of the casing, the inner cylinder must be constructed to surround the outer periphery of the worm wheel in order to protect the worm wheel from water, in which case the peripheral wall of the casing should be extended more outward to ensure a space for defining the trough groove, resulting in an inevitably larger diameter of the casing. However, a problem of hindering a reduction in size. Further, since the drain port is simply formed at a comer of the bottom of the casing and the peripheral wall, sufficient care should be taken against water entering through the drain port from the outside which may further reach into the casing. Thus, the shown structure cannot be employed as it is, and here exist problems to be solved by the present invention.

SUMMARY OF THE INVENTION

To solve the problems, the present invention provides a cable driving device comprising a bottomed and cylindrical-shaped casing having an opening at one side and facing a worm gear which is rotatable in association with a driven motor, a cover for closing the opening of the casing, a worm wheel incorporated in the casing and meshed with the worm gear, a drum wound with cables drawn out from the casing, and a damper for transmitting the driving force of the motor from the worm wheel to the drum in a damped state (shock-absorbed state), wherein the damper and the drum are formed respectively with damper bodies and drum tongues fitted into cavities formed through the worm wheel in opposition to each other in a rotating direction about an axis, the casing comprises draw-out guides protrusively formed in a groove shape with its casing opening side opened for drawing out the cables extending from the drum, and the cover is protrusively formed with guide closures for closing the draw-out guides. With such an arrangement, the cables can be drawn out from the casing by inserting the cables into the groove-shaped draw-out guides with the cables being wound around the drum, thereby improving the assembling operability and also enabling automated assembly.

By the thus constructing the cable driving device, despite a damper-based mechanism which does not require a pair of coil-type springs, a power transmission mechanism comprising a damping function implemented by the worm wheel, the damper and the drum can be accommodated within the thickness of the worm wheel to reduce the thickness of the overall casing. Also, the worm wheel, the damper and the drum are disposed in close proximity to one another to reduce the number of parts. Further, since the power transmission having the damping function can be performed within the thickness of the worm wheel, highly efficient power transmission is accomplished.

In the cable driving device, the damper bodies are fitted into the cavities formed through the worm wheel from the casing opening side, and the damper tongues are fitted into the cavities from the casing opening side so as to be opposite to the fitted damper bodies in the rotating direction about the axis, in which case, the worm wheel, the damper and the drum can be sequentially assembled into the casing from the casing opening side, thereby simplifying the assembling operations.

In the foregoing structure, the cable driving device can be characterized in that the cover is formed with a fitting portion for loosely fitting the drum from an end portion on a cable winding side, in which case the drum wound with the cables can be placed closer to the opening of the casing, the depth of the grooves of the draw-out guides can be reduced, the closing of the draw-out guides with the cover can improve the water-proof capability with a reduced seal margin, and the depth of the casing can be made as thin as possible, thereby reducing the size of the device.

Further, in the foregoing structure, the cable driving device can be characterized in that the casing includes a supporting shaft protruded from the bottom toward the opening side, the worm wheel and the drum are rotatably supported on the supporting shaft, and the cover is formed with a shaft support for receiving and supporting a distal end of the supporting shaft, in which case the worm wheel and the drum are supported by the supporting shaft which has both ends supported by the casing and the cover, thereby supporting the worm wheel and drum securely.

Furthermore, in the foregoing structure, the cable driving device can be characterized in that the damper is accommodated within the thickness of the worm wheel, and the drum is disposed adjacent to the casing opening side of the worm wheel with the damper accommodated therein, in which case a power transmission path from the worm wheel to the drum through the damper is made shorter in the axial direction, thereby further improving the power transmission efficiency.

Also, a casing peripheral wall is formed with draw-out guides for drawing out the cables extending from the drums, and a drain port for discharging water in the casing, and the casing includes a conduit trough assembled therein on the casing opening side for guiding water having entered therein from the draw-out guide to the drain port.

In this way, water can be prevented from entering into the worm wheel without increasing the size of the casing.

In the cable driving device, the conduit trough of the present invention can be integrally formed with connector pieces which are fitted into guide holes of the draw-out guides.

Further, in the cable driving device, the conduit trough of the present invention can have a U-shape in cross-section which is open on the same side as the casing opening, and the bottom of the conduit trough can be formed to extend from the position of a casing peripheral wall to a position at which the conduit trough overlaps with the worm wheel on the casing opening side.

The conduit trough of the present invention can have the bottom formed in the shape of ring opposing the outer periphery of the worm wheel.

Also, in the cable driving device, the cable drum is formed with a collar protruding outwardly in a radial direction from the edge opposite to the worm wheel for guiding water attached to the cable drum toward the drain port to prevent the water from entering into the worm wheel.

In this way, the water having entered into the cable drum side can be prevented from further entering into the worm wheel.

Furthermore, the casing peripheral wall is formed with draw-out guides for drawing out the cables to the outside, and a drain port for discharging water in the casing to the outside, the worm wheel is formed with a protrusion around the outer periphery thereof on the cable drum side, wherein the protrusion is formed to oppose the outer periphery of the cable drum, and the protrusion has an inclined inner peripheral surface which has a larger diameter toward the distal end of the protrusion.

In this way, water having entered into the cable drum can be prevented from further entering into the worm wheel.

In the cable driving device, the protrusion of the present invention can be formed with a guide protrusion at a distal end thereof, protruding outwardly in a radial direction.

Further, in the cable driving device, the peripheral wall of the casing of the present invention can be formed with a rib protruding inwardly in the radial direction to oppose the guide protrusion on the bottom side of the casing.

Also, in the cable driving device, the draw-out guides of the present invention can include water-proof caps inserted into distal ends thereof.

Further, in the cable driving device, the drain port can be formed through the casing, and include a lower side extending to the bottom of the casing in a state in which the casing opening side is closed by the cover, and an upper side continuous from the bottom of the casing and can be set at a length overlapping with the lower side. Moreover, in this case, the upper side comprises a short casing peripheral wall which extends along the edge of the casing peripheral wall on the cover side not to a position at which the upper side is closed by the cover, but to a position at which the upper side overlaps with the lower side.

DESCRIPTION OF THE PREFERRED EMBODIMENTS

Figure 1:
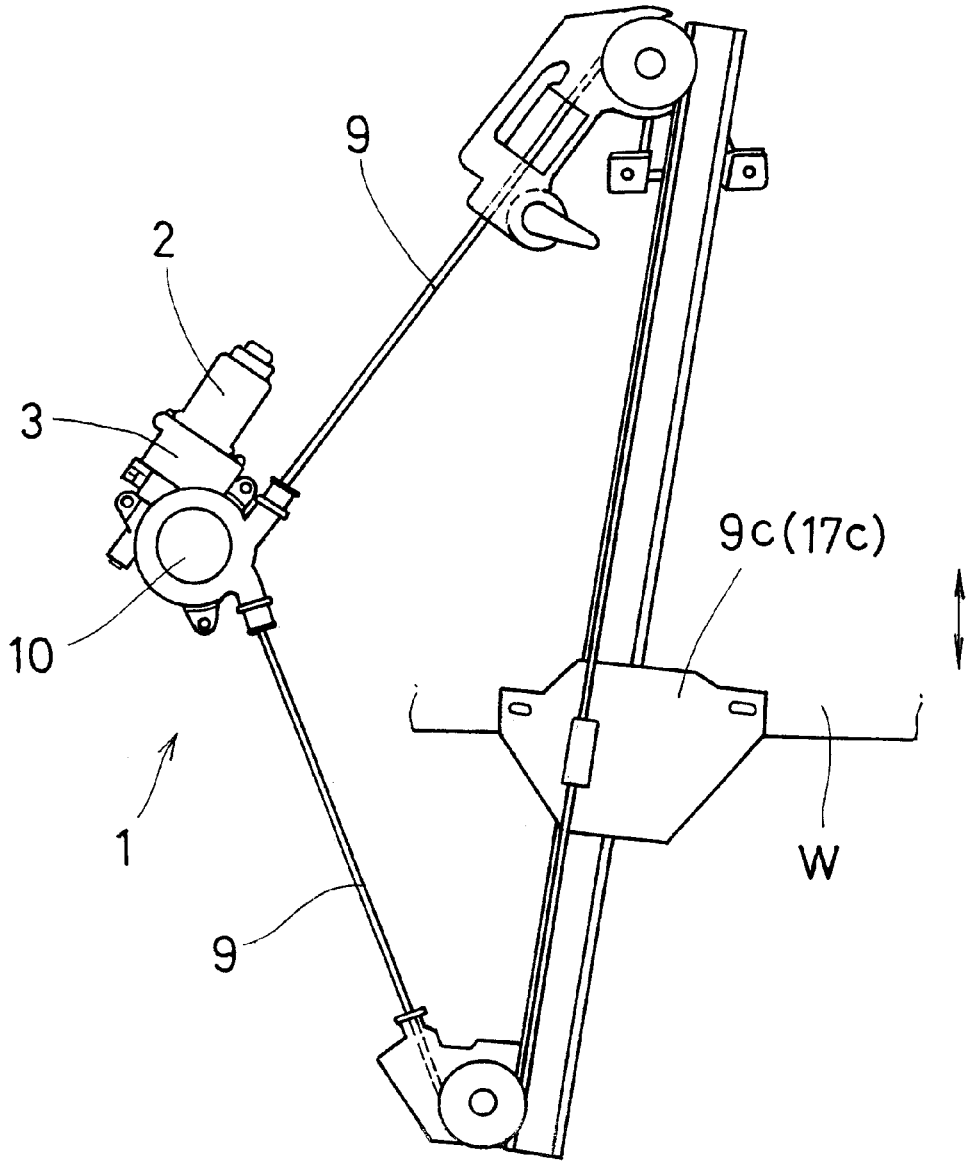
FIG. 1 is a schematic diagram showing a window regulator mounted to a door.
Figure 2:
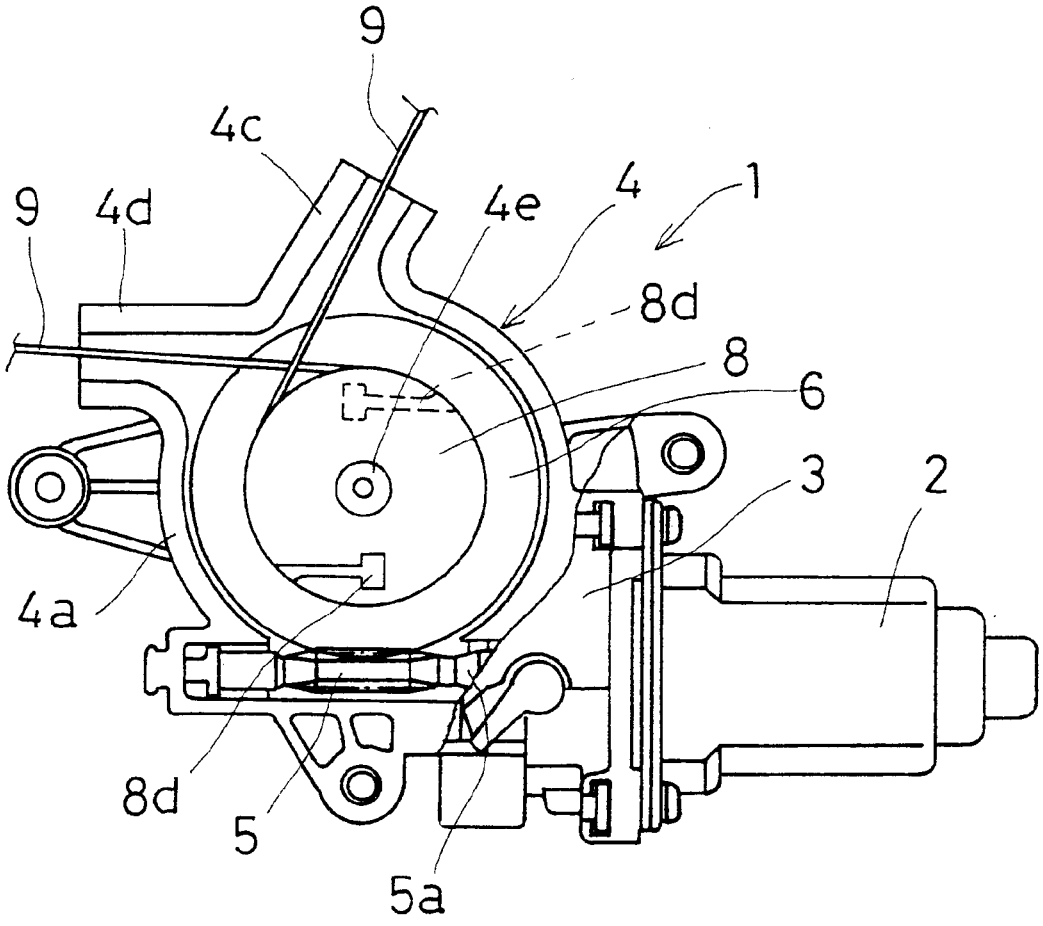
FIG. 2 is a partially cut-away front view of a cable driving device.

A first embodiment will be described below with reference to FIGS. 1 to 5. In the drawings, reference numeral 1 designates a device for driving a window regulator employed in a power window. An armature, not shown, is rotatably supported on a closed cylindrical motor case (serving also as a motor yoke) 2 which forms part of the driving device 1. A front bracket 3 is integrally secured in an opening of the motor case 2. The front bracket 3 is integrally formed with a closed cylindrical casing 4 such that it is oriented orthogonally to a motor shaft (armature shaft) 5*a* extending from the armature. Then, a window 4*b* for exposing a worm gear 5 formed on the motor shaft 5*a* is formed through a peripheral wall 4*a* of the casing 4 on the bottom side. Further, the peripheral wall 4*a* of the casing 4 is formed with draw-out guides 4*c*, 4*d* for drawing cables 9, described later, therefrom. The draw-out guides 4*c*, 4*d* protrude from the peripheral wall 4*a* in a recessed groove shape and open to the opening side of the casing 4. Then, a pair of the cables 9 are fed out and wound up by the rotation of the driven motor to forcedly move an actuator member 9*c* connected to the cables 9 in the vertical direction, thereby opening and closing a window glass W through motor driving.

Reference numeral 6 designates a worm wheel meshed with the worm gear 5, which worm wheel 6 opposes the bottom of the casing 4 in close proximity, and has a boss 6*a* rotatably supported a supporting shaft 4*e* protrusively formed integrally with the bottom of the casing 4 at the position of the axial center of the casing 4. The worm wheel 6 comprises the boss 6*a* and a rim 6*b* having gear teeth formed around the outer periphery thereof, meshed with the worm gear. Arms 6*c* are located at predetermined angles (120 degrees in this embodiment) in the rotating direction about the axis for connecting the rim 6*b* to the boss 6*a*. A plurality of cavities (n: three in this embodiment) 6*d* are formed bordered by the arms 6*c*, the rim 6*b* and the boss 6*a* in the rotating direction about the axis of the worm wheel 6. Specifically, the cavities 6*d* may be formed so as to allow damper bodies 7*a*, 7*b*, described later, to be fitted therein from the casing opening. Therefore, instead of the cavities extending through the worm wheel 6 as in this embodiment, recesses open to the casing opening side may be used.

Reference numeral 7 designates a damper formed of a rubber-based elastic material. The damper 7 comprises a number of damper bodies 7*a*, 7*b*, twice the number of the cavities (2*n*: six in this embodiment), and a ring-shaped connector 7*c* for connecting the ends of the damper bodies 7*a*, 7*b* proximal to the center with a predetermined spacing S between the respective damper bodies 7*a*, 7*b*, where a set of damper bodies 7*a*, 7*b* is fitted into one cavity 6*d*. Then, in this event, the damper bodies 7*a*, 7*b* are designed to be fitted into the associated cavities 6*d* while they substantially abut to the arms 6*c* on both sides in the rotating direction about the axis, forming the cavities 6*d*. It should be noted that while the spacing between adjacent damper bodies may be adjusted by the thickness of the arms 6*c*, the spacing S may be set equal to the thickness of the arms 6*c* (the width of the arms 6*c* in the rotating direction about the axis) to result in the same spacing between the damper bodies 7*a*, 7*b* in all the sets, thereby eliminating the difference between the damper bodies 7*a*, 7*b* and improving the ease of assembly. Also, when the damper bodies 7*a*, 7*b* are fitted in the cavities 6*d*, the connector 7*c* is fitted in a recessed groove 6*e* formed in the boss 6*a*, so that the damper 7 is accommodated within the thickness of the worm wheel 6 and does not protrude from the side surface of the casing opening of the worm wheel 6. The outer peripheral surfaces of the damper bodies 7*a*, 7*b* are spaced apart from the inner peripheral surface of the rim 6*b* to form a margin space (expansion margin) when the damper bodies 7*a*, 7*b* are compressed.

Reference numeral 8 designates a cylindrical drum which is formed with a guide groove 8*a* on an outer peripheral surface of an upper half thereof (near the casing opening), so that the pair of cables 9 are spirally wound therealong, and with a fitting hole 8*b* extending through a central portion thereof for the drum 8 to rotatably fit on the supporting shaft 4*e*. The drum 8 is also formed with a number of tongues 8*c* equal to the number of the worm wheel cavities 6*d* (n: three in this embodiment), protruding from the lower surface (the surface opposing the bottom of the casing) in the lower half of the drum 8, and spaced therebetween by an angular distance equal to that between the arms 6*c*. Then, the drum 8 is set such that the supporting shaft 4*e* extends through the fitting hole 8*b* and the tongues 8*c* are fitted into the respective spacings S between the pairs of damper bodies 7*a*, 7*b* each fitted into one of the cavities 6*d*. The guide groove 8*a* of the drum 8 thus assembled is wound with the cables 9, and the pair of cables 9 extending from the drum 8 are drawn out through the draw-out guides 4*c*, 4*d*. The drum 8 is formed with holders 8*d* on both end surfaces thereof for holding the base ends of the cables 9 to prevent the cables 9 from coming off.

Reference numeral 10 designates a cover for closing the opening of the casing 4. The cover 10 is formed with guide closures 10*a* extending therefrom for closing the draw-out guides 4*c*, 4*d*, and is further formed in the central portion thereof with a shaft support 10*b* as a recess for receiving the distal end of the shaft 4*e* to support the same. Around the shaft support 10*b*, the cover 10 is also formed with a drum fitting space 10*c* as a recess for loosely receiving the drum 8 from the casing opening side to prevent the cables 9 from sagging.

In the first embodiment constructed as described above, the cable driving device 1 is assembled in the following manner. First, the worm wheel 6 is assembled into the casing 4, and then the damper 7 is assembled into the worm wheel 6 such that each set of damper bodies 7*a*, 7*b* is fitted into the same cavity 6*d*. Subsequently, the drum 8 is assembled such that the tongues 8*c* are fitted into the spacings S between the respective damper bodies 7*a*, 7*b* of the sets. Then, the cables 9 would around the drum 8 are drawn out and placed on the draw-out guides 4*c*, 4*d* from the casing opening side, followed by closing the opening of the casing 4 with the cover 10. As a result, the cable driving device 10 can be simply assembled by sequentially fitting the worm wheel 6, the damper 7, the drum 8 and the cable 9 from the opening side of the casing 4, or by previously winding the cables 9 around the drum 8, and sequentially assembling the worm wheel 6, the damper 7 and the drum 8 wound with the cables, thereby eliminating troublesome operations such as passing cables through throughholes, which would be required in the prior art. Since the cables 9 as wound around the drum 8 can be drawn out from the casing 4, the operability is improved, and automated assembly can also be accomplished.

Moreover, in the first embodiment, the damper bodies 7*a*, 7*b*, serving as a damper mechanism for absorbing shock, and the tongues 8*c* overlap in the thickness direction of the worm wheel 6, so that the casing 4 can be reduced in height as compared with the conventional cable driving device which separately ensures a space for arranging a damper mechanism in an axial direction, thus contributing to a reduction in size, and allowing for readily accommodation within a thin door. Furthermore, since the power transmission from the worm wheel 6 to the drum 8 having a damping function through the damper 7 is performed within the thickness of the worm wheel 6, the power can be transmitted with a reduced loss, resulting in an improved transmission efficiency. Further, since these components are arranged in close proximity to each other, no parts are required for connecting them. In addition, since the worm wheel 6 itself serves also as a member for forming part of the damper mechanism, the number of parts is reduced, thus contributing to a simplified construction.

Also, since the cover 10 is formed with the drum fitting space 10*c* for loosely receiving the drum 8 from the opening side of the casing 4, the drum 8 wound with the cables can be positioned near the open edge of the casing, so that the draw-out guides 4*c*, 4*d* formed in the casing 4 can also be reduced in height. Further, the guide closures 10*a* for covering the draw-out guides 4*c*, 4*d* require a reduced seal margin and hence improve the water-proof performance, and the casing 4 can be reduced in depth (the height of the peripheral wall), thereby accomplishing a further reduction in size of the device.

Also, the shaft 4*e* for supporting the worm wheel 6 and the drum 8 is supported on both ends by the bottom of the casing 4 and the cover 10, so that the worm wheel 6 and the drum 8 are securely supported to eliminate run-out.

Further, despite the cable driving device having the damper 7 for providing a damping function, the damper 7 is accommodated in the worm wheel 6, so that the worm wheel 6 and the drum 8 can be arranged to directly oppose each other, resulting in a further reduction in size and an improved transmission efficiency.

Of course, the manner of assembling the cable driving device of the present invention is not limited to that shown in this embodiment. In essence, for constructing a cable driving device comprising a casing formed in a one-side-open closed cylinder, and facing a worm gear rotatable in association with a driven motor; a cover for closing the opening of the casing; a worm wheel arranged in the casing and meshed with the worm gear; a drum wound with cables which are drawn out from the casing; and a damper for transmitting the motor driving power from the worm wheel to the drum in a damping state, the damper and the drum are only required to have damper bodies and drum tongues, respectively, which are formed to fit in spaces formed through the worm wheel in opposition to each other in the rotating direction about the axis. Thus, no limitations are made particularly on a procedure of assembling the worm wheel, the drum and the damper into the casing.

Next, a second embodiment of the present invention will be described with reference to the drawings of FIGS. 6 to 10, where water-proof features are additionally provided.

In the drawings, reference numeral 11 designates a cable driving device for a window regulator employed for a power window. An armature shaft (motor shaft) 13 of an armature, not shown, is rotatably supported in a motor case (serving also as a motor yoke) 12 shaped in a closed cylinder, forming part of the cable driving device 11. A front bracket 14 is integrally secured to an opening of the motor case 12. The front bracket 14 is integrally formed with a closed cylindrical casing 15, described later, so as to be oriented orthogonally to the armature shaft 13. The casing 15 is adapted to accommodate a worm wheel 16, described later, and a cable drum 18 wound with cables 17, and is closed with a cover 19.

The casing 15 rotatably accommodates the worm wheel 16 close to a bottom 15*a*. An open end of a cylindrical wall 15*b* is elongated to oppose the outer periphery of the cable drum 18 which is to be accommodated in the casing 15 on the opening side, as will be described later. Then, the bottom 15*a* is integrally formed with a supporting shaft 15*d* protruding toward the opening side, and a window 15*c* is formed through the peripheral wall 15*b* near the bottom 15*a*, so that a worm 13*a* engraved in an end portion of the motor shaft 13 faces the inside of the casing 15 through the window 15*c*.

Further, a pair of first and second draw-out guides 20, 21 are formed on the peripheral wall 15*b* on the opening side of the casing. The draw-out guides 20, 21 are adjacent to each other in a circumferential direction and protrude outwardly away from each other. Distal ends 17*a*, 17*b* of a pair of cables fed out of the cable drum 18 are passed through the first and second draw-out guides 20, 21 and drawn to the outside. The first and second draw-out guides 20, 21 are formed in a recessed groove of semi-arc in cross-section. The casing peripheral wall 15*b*, which constitutes proximal ends of the first and second draw-out guides 20, 21, has opening side portions cut away to form notches 15*e* through which the first and second draw-out guides 20, 21 are in communication with the inside of the casing 15.

The worm wheel 16 is formed along the outer periphery with a gear 16*a* meshed with the worm 13*a* and with a boss 16*b* at the position of the axial center. Then, the wheel 16 has the boss 16*b* rotatably supported on the supporting shaft 15*d* on the casing bottom 15*a*, so that the worm wheel 16 is rotatably accommodated in the casing 15. Also, the worm wheel 16 is formed with fitting grooves 16*e* spaced apart by a predetermined interval in a rotating direction about the axis, in one wheel surface (opening side wheel surface) 16*c* facing the opening side of the casing 15, toward the other wheel surface (bottom side wheel surface) 16*d*.

Also, the cable drum 18 is formed in a cylinder of a smaller diameter than that of the worm wheel 16, and is formed on the outer peripheral surface with a cable groove 18*a* along which the cables are spirally wound. The cable drum 18 is also formed with a fitting hole 18*b* extending through a central portion thereof for the drum 18 to rotatably fit on the casing shaft 15*d*. Tongues 18*c* are formed protruding from one surface of the cable drum 18 (the surface opposing the bottom 15*a* of the casing) to fit into the fitting grooves 16*e* of the worm wheel together with a damper 22. Here, the damper 22, which is formed of a rubber-based elastic material, comprises an annular connector 22*a* which is fitted on the outer periphery of the boss 16*b* of the worm wheel, and damper bodies 22*b* formed integral with the connector 22*a* and radially extending toward the outside.

Figure 3:
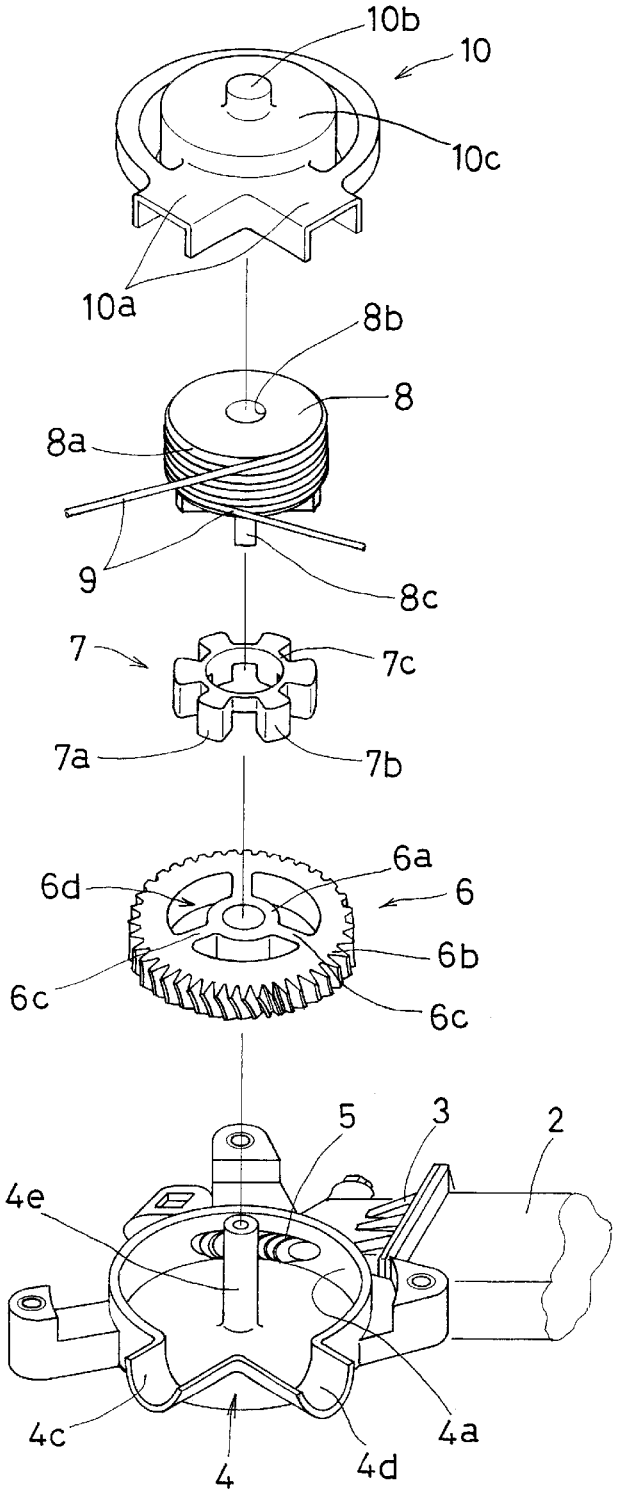
FIG. 3 is an exploded perspective view of the cable driving device.
Figure 4:
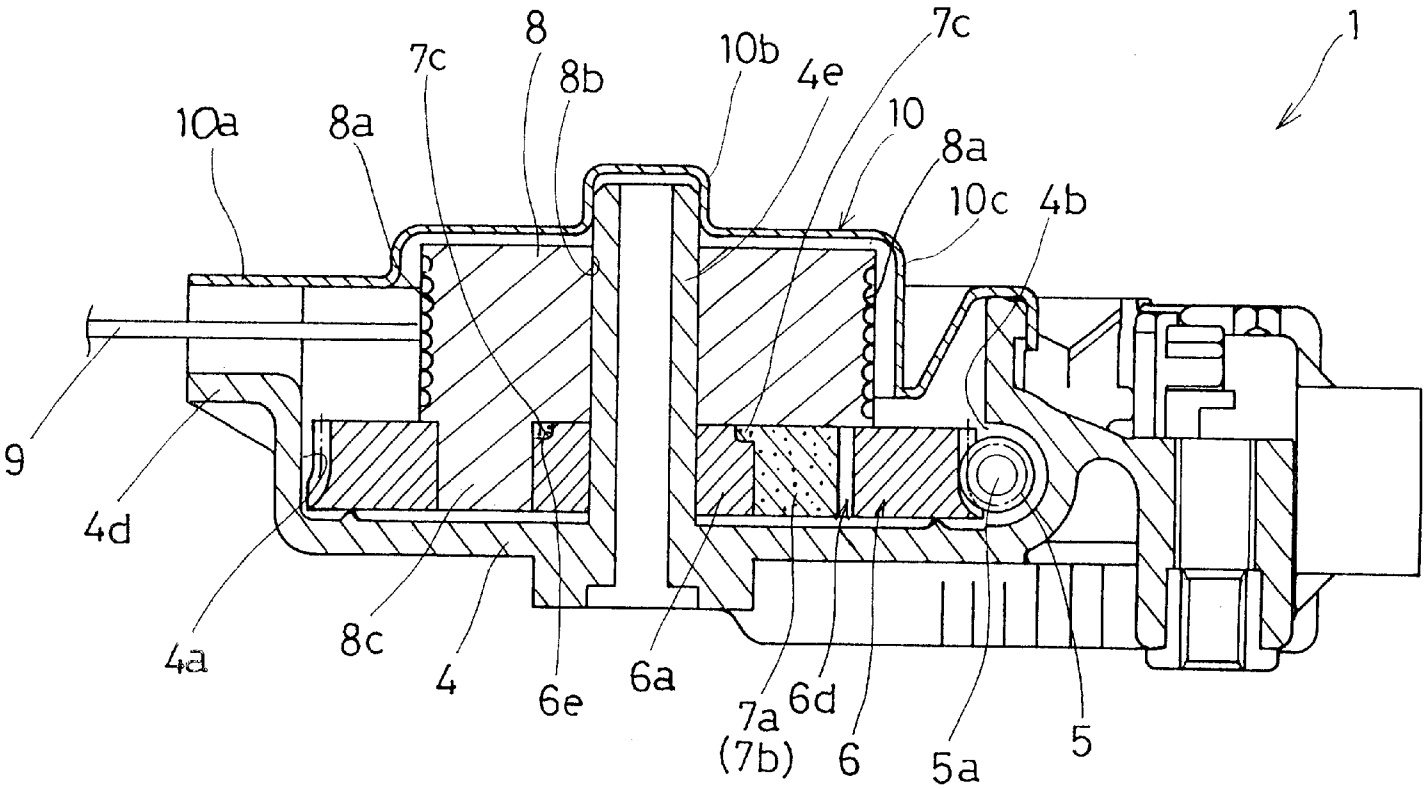
FIG. 4 is a cross-sectional view of the cable driving device.
Figure 5:
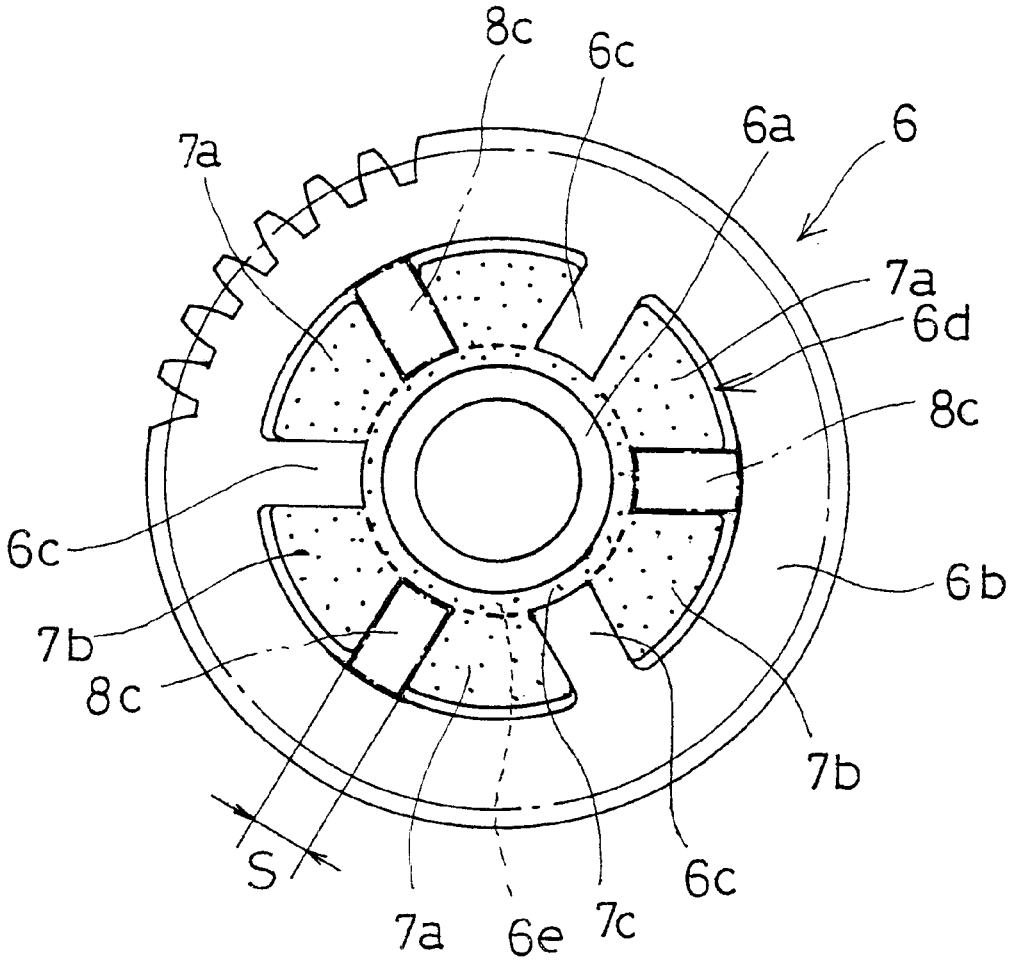
FIG. 5 is a front view showing a worm wheel in which a damper is assembled.
Figure 6:
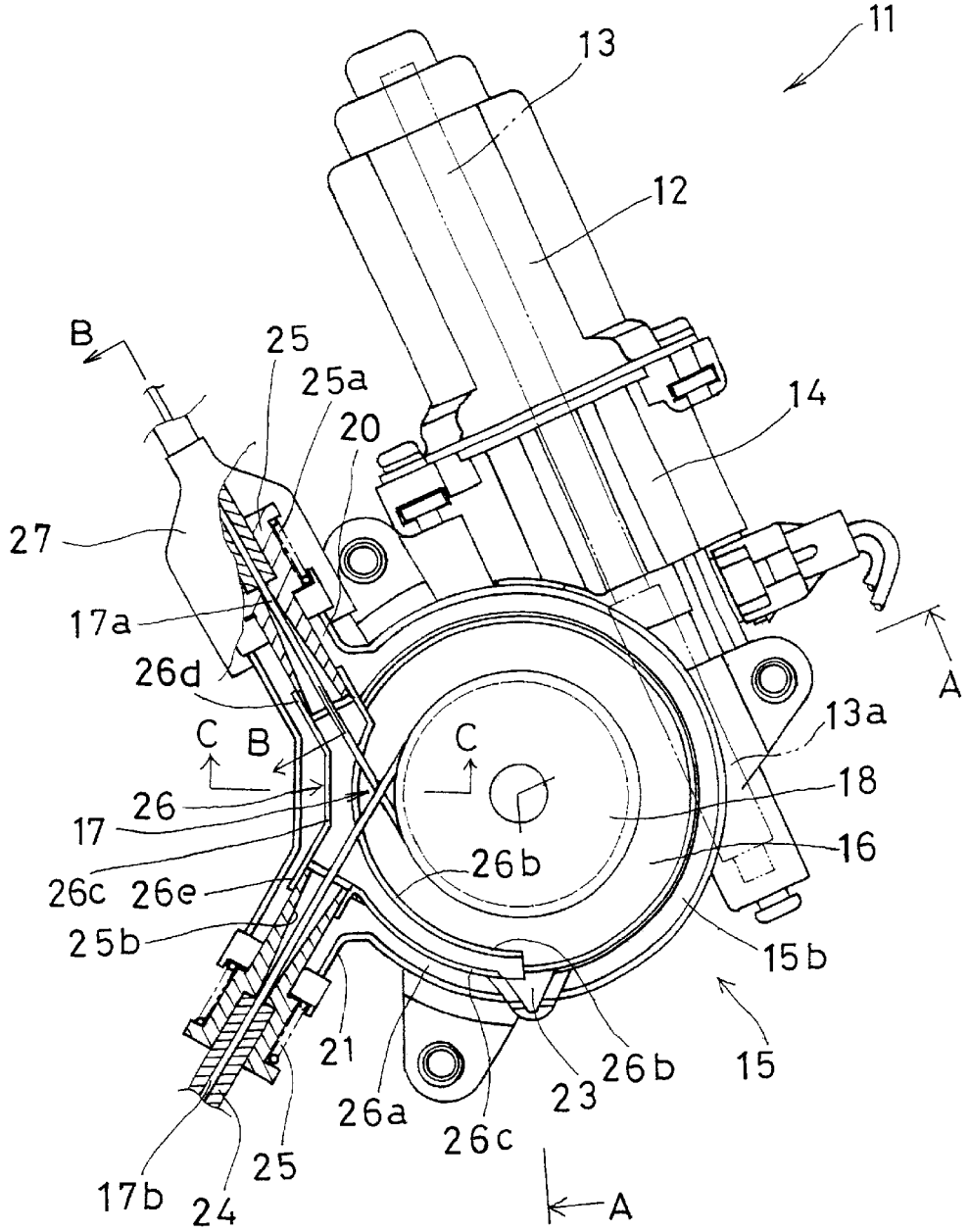
FIG. 6 is a partially sectioned front view of a cable driving device according to a second embodiment from which a cover has been removed.
Figure 7:
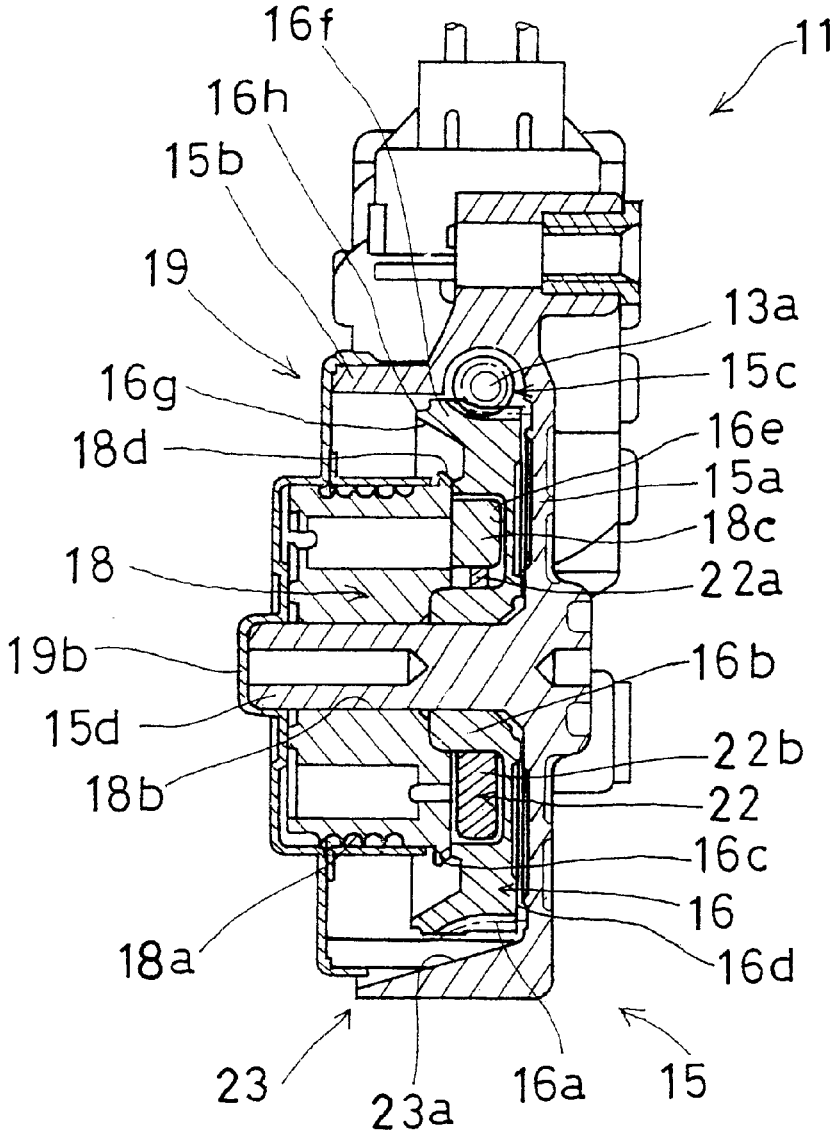
FIG. 7 is a cross-sectional view taken along the line A—A in FIG. 6 when the cover is attached.
Figure 8:
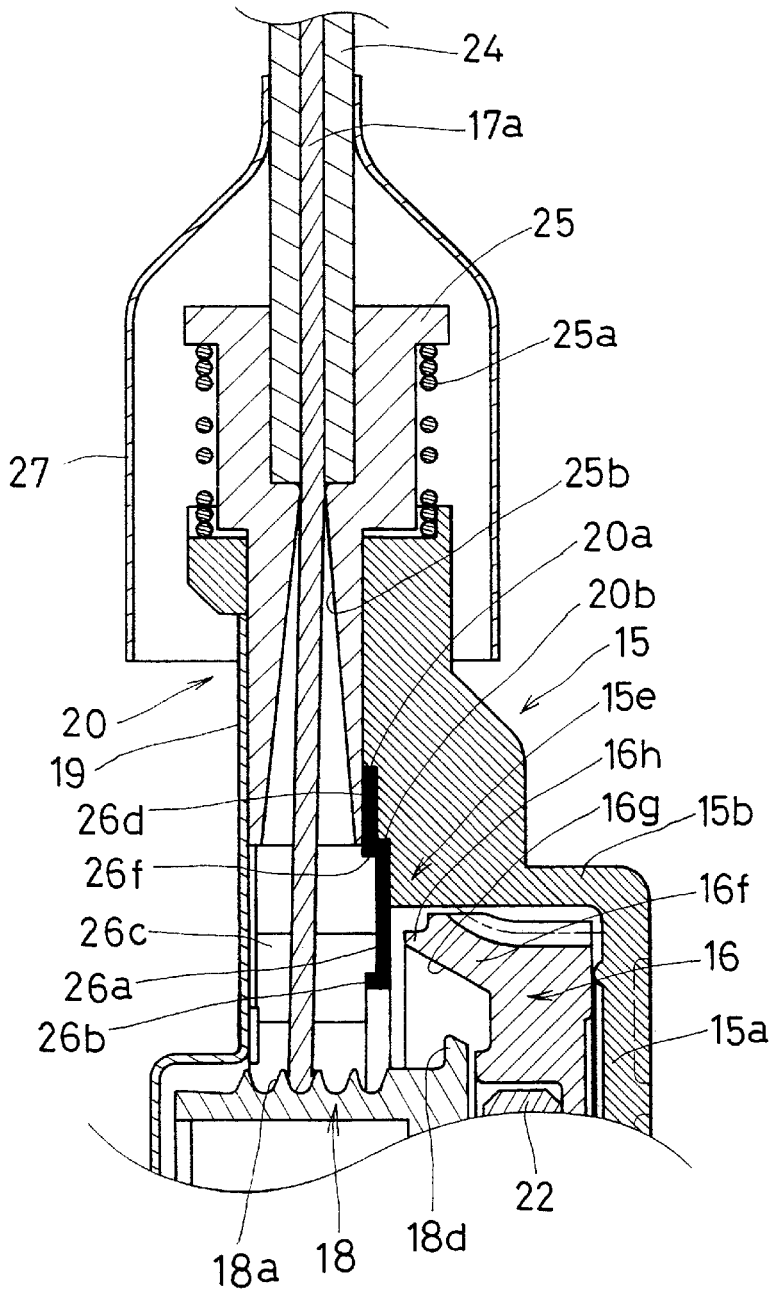
FIG. 8 is a cross-sectional view taken along the line B—B in FIG. 6 when the cover is attached.
Figure 9:
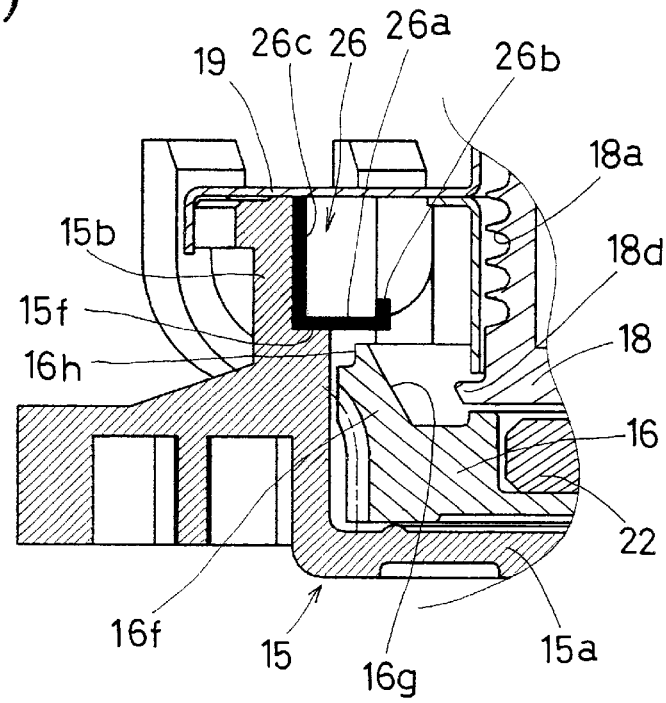
FIG. 9A is a cross-sectional view taken along the line C—C in FIG. 6 when the cover is attached.
FIG. 9B is an enlarged cross-sectional view of a main portion of FIG. 9A.
Figure 9:
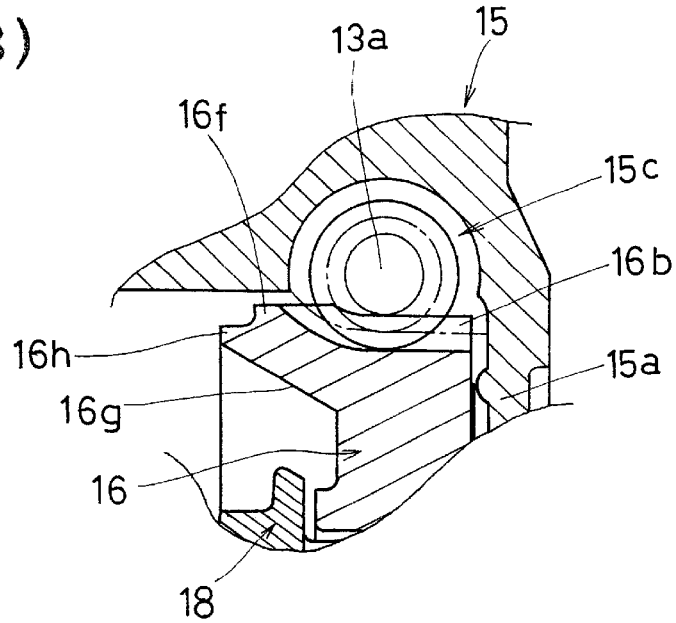
Figure 10:
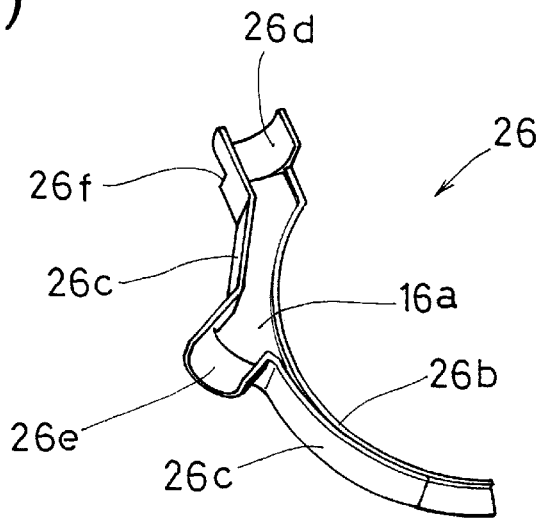
FIG. 10A is a perspective view showing a conduit trough viewed from a view point.
FIG. 10B is a perspective view showing a conduit trough viewed from another view point.
Figure 10:
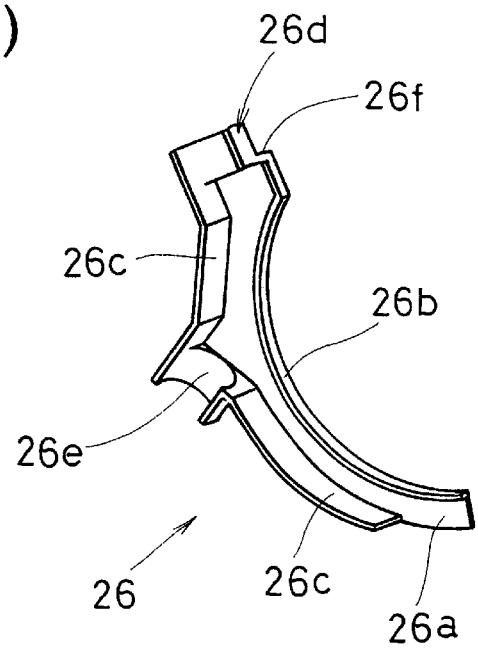

Then, the worm wheel 16, the damper 22, and the cable drum 18 are assembled into the casing 15 from the opening thereof. Specifically, the worm wheel 16 is placed adjacent to the bottom 15*a* of the casing in such a manner that the boss 16*c* is fitted on the casing shaft 15*d*. Subsequently, the connector 22*a* of the damper 22 is fitted on the outer periphery of the boss 16*c* of the worm wheel, while the damper bodies 22*b* are fitted into the fitting grooves 16*e* of the worm wheel, to assemble the damper 22 into the casing 15. Thereafter, the cable drum 18 wound with the cables 17 along the cable groove 18*a* is assembled into the casing 15 on the opening side. In this event, the cable drum 18 is assembled into the casing by inserting casing shaft 15*d* into the fitting hole 18*b* and by fitting the tongues 18*c* into the fitting grooves 16*e* of the worm wheel adjacent to the damper bodies 22*b* previously fitted in the fitting grooves 16*e*. By thus assembling the cable drum 18 into the casing, the cable drum 18 is formed integral with the worm wheel 16, and the damping function provided by the damper 22 is exhibited in the transmission of power from the worm wheel 16 to the cable drum 18. Then, a pair of distal ends 17*a*, 17*b* of the cables 17 are routed into the first and second draw-out guides 20, 21 of the casing 15. Since the resulting structure is similar to that of the first embodiment, the presentation of an exploded perspective view such as FIG. 3 is omitted for this structure.

The substantially disc-shaped cover 19 for covering the opening of the casing 15 is integrally formed with a pair of guide closures 19*a*, which project outwardly in radial directions, for covering the opening of the first and second draw-out guides 20, 21. The cover 19 is also integrally formed with a fitting space 19*b* in a central portion thereof for loosely fitting the distal end of the casing shaft 15*d*.

In the cable driving device 11 thus assembled, the distal ends 17*a*, 17*b* of the pair of cables are drawn out from guide holes formed by the draw-out guides 20, 21 and the guide closures 19*a*, and the drawn distal ends 17*a*, 17*b* of the cables are tied to an actuator plate 17*c* of the window regulator. As the armature shaft 13 is rotated, the worm wheel 16 is rotated to cause the cable drum 18 to rotate together, whereby the distal end 17*a* of the cable is fed out, whereas the distal end 17*b* of the other cable is wound up to forcedly move the actuator plate 17*c* in the vertical direction, to open and close the window.

Next, a water-proof structure of the cable driving device 11 will be described. In this embodiment, the cable driving device 11 is mounted to a chassis in such a state that the radial direction of the casing 15 is oriented in the vertical direction, while the axial direction of the same is oriented in the horizontal direction. In the mounting state mentioned above, a portion at the lower end of the casing peripheral wall 15*b* protrudes outwardly in the radial direction, and this protrusion serves as a drain port 23 for discharging water which has entered into the casing 15. The inner peripheral surface of protrusive drain port 23 forms an inclined surface 23*a* which is inclined more downwardly toward the opening. Thus, the inclined surface 23*a* is designed to actively guide water within the casing 15 toward the opening.

Also, in the mounting state described above, the pair of first and second draw-out guides 20, 21 of the casing 15 are arranged such that the distal end of the first draw-out guide 20, from which the cable is drawn out, is oriented diagonally upward, while the distal end of the second draw-out guide 21 is oriented diagonally downward. Then, the cables 17 drawn out from the first and second draw-out guides 20, 21, respectively, are inserted into and secured to outer wires 24 which are designed to maintain a constantly stretching state of the associated cables by joints 25 which are removably inserted into distal ends of the guide holes of the first and second draw-out guides 20, 21, respectively, through springs 25*a*. The joints 25 are each shaped in a cylindrical shape, and an inner cylindrical surface 25*b*, through which the cable 18 passes, is formed to have a diameter diverging toward the inside of the casing 15, thereby absorbing a shift of the cable 17 in a feed-out direction corresponding to a change in a wound position on the cable drum 18.

Further, in this embodiment, a conduit trough 26 is incorporated at a site at which the first guide 20 and the second guide 21 are bridged to the drain port 23. The conduit trough 26 is arranged in a space defined between the peripheral wall 15*b* on the opening side of the casing 15 and the outer periphery of the cable drum 18 of a smaller diameter. In this way, water entering through the first and second draw-out guides 20, 21, particularly through the upwardly oriented first draw-out guide 20, is guided to the drain port 23 through the conduit trough 26 and discharged to the outside of the casing 15, thereby providing a first water-proof feature.

The conduit trough 26 has a U-shape in cross-section which is open on the same side as the opening of the casing 15, and is incorporated such that a bottom 26*a* opposes the bottom 15*a* of the casing. The bottom 26*a* is integrally formed on both inner and outer sides in the radial direction with an inner leg piece 26*b* and an outer leg piece 26*c* , respectively, which protrude toward the opening side of the casing 15. Further, the conduit trough 26 is integrally formed with first and second connector pieces 26*d*, 26*e* on an upper end and the outer leg piece 26*c*, respectively, which are connected to the base ends of the first and second draw-out guides 20, 22.

The casing peripheral wall 15*b* is formed with the notches 15*e* at the sites opposite to the base ends of the first and second draw-out guides 20, 21, as mentioned above, such that the cables 18 pass through the notches 15*e*. The notches 15*e* are formed in such a manner that their end face position on the opening side are located slightly closer to the opening side than the position of the wheel surface 16*c* on the opening side of the worm wheel 19.

Further, the first draw-out guide 20 is formed on a base end portion with an arcuate first step 20*a* so as to define a gap having a predetermined spacing between the outer periphery of the base end of the joint 25 and the first draw-out guide 20, and a distal end of the first connector piece 26*d* of the conduit trough 26 is set to be inserted into the gap. In this way, water entering along the inner cylindrical surface 25*b* of the joint 25 is securely guided toward the bottom 26*a* of the conduit trough 26. Further, a second step 20*b* is formed on the inner side of the first step 20*a* of the first draw-out guide 20 in the radial direction, such that a step 26*f* formed between the first connector piece 26*d* and the bottom 26*a* abuts to the second step 20*b*. Also, an end surface formed by the second step 20*b* is continuous to an axial end surface formed by the notch 15*e* of the casing, and a radially outer portion of the bottom 26*a* of the conduit trough is carried on the end surface. Although omitting detailed description on how the second connector piece 26*e* of the conduit trough 26 is connected to the second draw-out guide 21, they are constructed in a similar manner to the connection of the first connector piece 26*d* of the conduit trough to the first draw-out guide 21.

Further, inner peripheral surface regions of the casing peripheral wall 15*b* positioned between the sites at which the first and second draw-out guides 20, 21 are formed, and between the second draw-out guide 21 and the drain port 23 are cut away to form a stepped surface 15*f* continuous to the end surface formed by the notch 15*e*, so that the radially outer portion of the bottom 26*a* of the conduit trough is carried on the stepped surface 15*f*.

Then, as mentioned above, the conduit trough 26 is inserted between the outer periphery of the base end of the joint 25 and the first draw-out guide 20 such that the distal end surfaces of the first and second connector pieces 26*d*, 26*e* abut to the first step 20*a* at the base ends of the first and second draw-out guides 20, 21, and is incorporated in the casing 15 on the opening side by carrying the outer side portion of the bottom 26*a* on the stepped surface 15*f* of the casing, and setting the outer leg piece 26*c* of the conduit trough abuts to the inner peripheral surface of the casing peripheral wall 15*e* on the opening side. In this assembled state, the conduit trough 26 has the opening oriented in the same direction as that of the opening of the casing 15, so that a lower end of the bottom 26*a* of the conduit trough 26*a* opposes the drain port 23 positioned in a lower end portion of the casing 15. Further, the inner side portion of the conduit trough 26 is extended inwardly from the gear 16*a* of the worm wheel 16, and opposes the wheel surface 16*c* on the opening side with a slight gap defined therebetween. In this way, the conduit trough 26 is assembled into the casing 15 such that it overlaps with the worm wheel 16 on the opening side of the casing 15. Thus, water entering along the inner cylindrical surface of the joint 25 flows into the conduit trough 26 rather than into the worm wheel 16, and is guided along the conduit trough 26 from the lower end of the bottom 26*a* of the conduit trough 26 to the drain port 23, thereby providing a first water-proof feature against water further entering into the worm wheel 16.

Here, the axial length of the outer leg piece 26*c* of the conduit trough 26 is determined to be the distance to the edge of the opening of the casing, whereas the axial length of the inner leg piece 26*b* is set to be short so as not to inhibit the action of the cables 17 wound around the cable drum 18.

Further, in the second embodiment, water entering between the outer peripheral surface of the joint 25 and the inner peripheral surfaces of the first and second draw-out guides 20 flows into a connection between the connector pieces 26*d*, 26*e* of the conduit trough 26 and the joint 25, so that the water is likely to enter into surrounding regions. To solve this problem, a water-proof cap 27 is attached to (inserted into) the distal end of the upwardly oriented first draw-out guide 20, from which the cable is drawn out, to account for the prevention of water entering from this part, thus providing a second water-proof feature.

Also, in the second embodiment, a third water-proof feature is provided against water entering along the cables 17, and water flowing into the cable drum 18 in the following manner. Specifically, the water entering along the cables 17 follows the cable drum 18 to enter toward the worm wheel 16. However, an end edge portion of the cable drum 18 opposing the worm wheel 16 is integrally formed with a collar 18*d* extending outwardly such that the water attached to the cable drum 18 is guided downwardly along the collar 18*d*, without being guided toward the worm wheel.

Also, a protrusion 16*f* is formed on the outer periphery of the opening side wheel surface 16*c* of the worm wheel 16 so as to overlap with the outer peripheral surface of the cable drum 18. The inner peripheral surface of the protrusion 16*f* is formed as an inclined surface 16*g* which has a larger diameter toward the distal end of the protrusion, and a guide protrusion 16*h* is integrally formed at the distal end of the protrusion. In this way, water guided by the collar 18*d* of the cable drum is received by the inclined surface 16*g*, and guided toward the guide protrusion 16*h*, whereby the guided water drops down to the drain port 23.

Further, the inner side portion of the conduit trough 26 overlaps with an outer portion of the worm wheel 16, as previously mentioned. The conduit trough 26 has a width wide enough so that the inner side portion of the conduit trough 26 extends to a portion opposing the inner side of the protrusion 16*f* formed on the wheel surface 16*c* on the opening side, i.e., the inclined surface 16*g*. With this structure, if an unforeseen accident such as water overflowing the conduit trough 26 occurred, the overflowing water would enter toward the cable drum 18 or toward the inclined surface 16*g* of the opening side wheel surface 16*c* of the worm wheel 16. The entering water, however, would be guided toward the guide protrusion 16*h* via the inclined surface 16*g*, and then guided to the drain port 23 through the casing peripheral wall 15*b*.

In the second embodiment constructed as described above, the cable driving device 11 opens and closes a window in a sequence of operations, wherein the rotation of the armature shaft 13 by the driven motor causes the worm wheel 16 to rotate, resulting in feeding out one of the distal ends 17*a* of the cables 17 having the outer wire 24, drawn out from the first and second guides 20, 21, and winding up the other distal end 17*b*. In this case, if the cable driving device 11 is drenched by a large amount of water, water attempting to enter from an interstice between the upwardly oriented first draw-out guide 20 and the joint 25 is protected by the water-proof cap 27 which provides the second water-proof feature. Also, water to be entered from the inner cylinder 25*b* of the joint 25 or the like will flow into the conduit trough 26 assembled such that it is inserted along the outer periphery of the base end of the joint 25, guided by the bottom 26*a*, and discharged from the drain port 23, thereby accomplishing the first water-proof feature. As a result, even if water enters into the casing 15 from the first and second draw-out groves 20, 21, the water is discharged from the drain port 23, and is prevented from further flowing into the worm wheel 16, thereby making it possible to prevent troubles such as oxidization of the worm 13*a* and deterioration of the damper 22 without fail.

Furthermore, water further entering into the cable drum 18, such as water attached along the cable 17, is restricted to enter into the worm wheel 16 by the collar 18*d* formed on the edge of the cable drum 18 adjacent to the worm wheel 16, and is guided downwardly along the collar 18*d*. The guided water is further guided to the guide protrusion 16*h* through the inclined surface 16*g* formed on the inner peripheral surface of the protrusion 16*f* of the worm wheel 16, and discharged from the drain port 23, thereby providing the third water-proof feature. Consequently, the worm wheel 16 and its surroundings are protected from water entering thereinto.

As described above, in the second embodiment, even if water enters into the casing 15, the casing 15 is protected by the water-proof features to discharge the water from the drain port 23, so that the water will not further enter into the worm wheel 16. In this case, however, the water-proof features do not rely on partitioning members, as conventionally used, to separate the casing into a cable drum accommodating chamber and a worm wheel accommodating chamber. Instead, the water-proof features are implemented by the conduit trough 26 incorporated in the casing 15 on the opening side; and the collar 18*d* formed on the cable drum 18; the inclined surface 16*g* formed on the inner peripheral surface of the protrusion 16*f* of the worm wheel 16; and the guide protrusion 16*h* at the distal end of the protrusion 16*f*, resulting in a reduced number of parts required therefor and simplified assembling operations. In addition, the conduit trough 26 can be fitted in a space defined between the outer periphery of the cable drum 18 and the peripheral wall 15*b* of the casing 15 on the opening side by making the cable drum 18 to have a diameter smaller than that of the worm wheel 16, so that the worm wheel 16 is protected from water without increasing the outer diameter of the casing 15, thus contributing to a reduction in weight and size.

Furthermore, since the cable driving device of the second embodiment does not include a structure in which a sealing material slides in contact with a rotatable member such as the worm wheel 16 and the cable drum 18, as is the case with the prior art device, the cable driving device free from abrasion and power loss can improve the reliability and the efficiency of the product.

Figure 11:
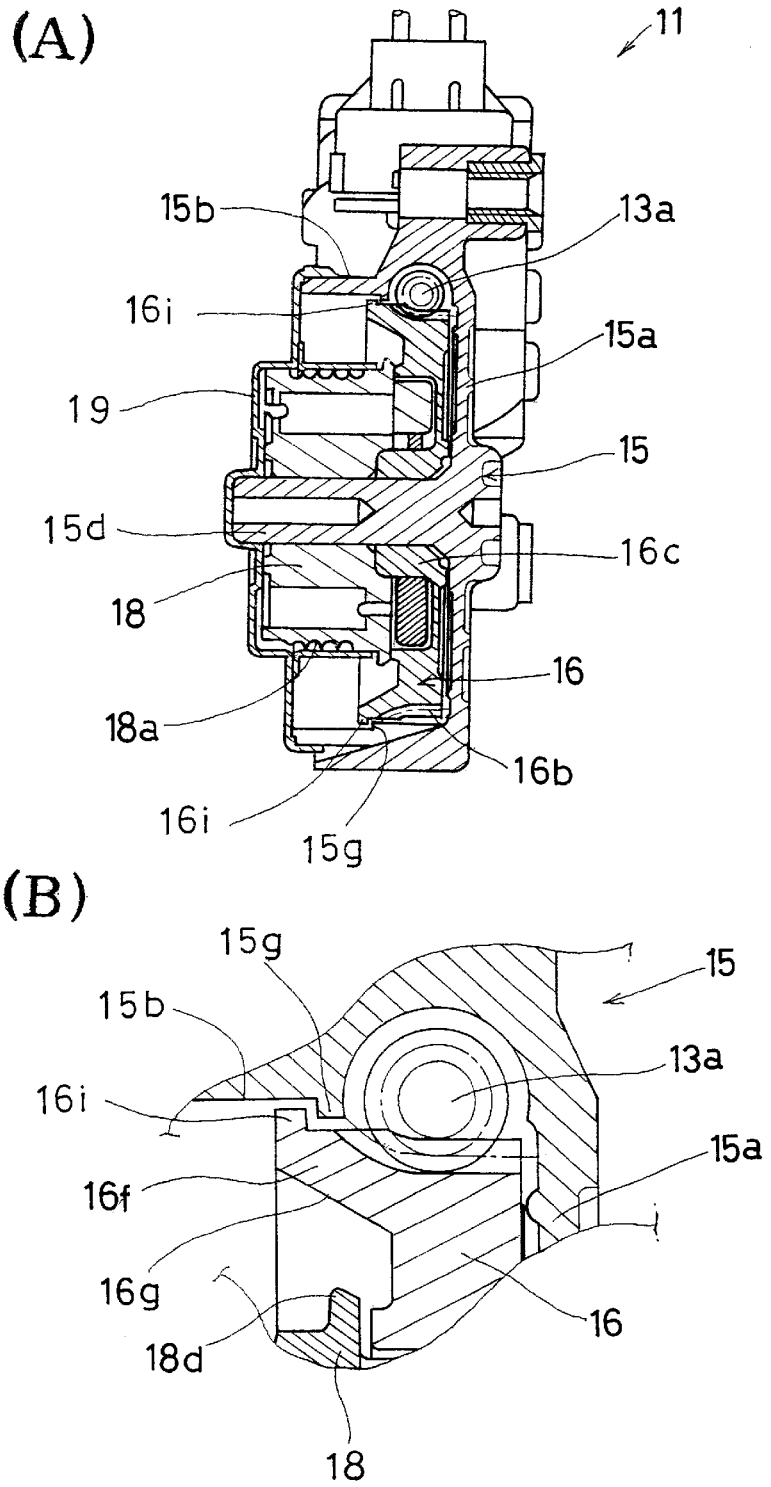
FIG. 11A is a cross-sectional view showing a cable driving device of a third embodiment.
FIG. 11B is an enlarged cross-sectional view of a main portion of the cable driving device of the third embodiment.

The water-proof features implemented by the present invention is of course not limited to the foregoing second embodiment, and may be modified as in the following third, fourth and fifth embodiments. In FIGS. 11 and subsequent figures, parts common (identical) to those in the second embodiment are referred to by the same reference numerals, and details thereof are omitted.

First, the third embodiment illustrated in FIG. 11 is a structure for the third water-proof feature which is implemented by a guide protrusion 16*i* formed around the distal end of the protrusion 16*f* of the worm wheel 16, extending outwardly in the radial direction. This structure likewise guides water flowing toward the guide protrusion 16*i* along the inclined surface 16*g* of the protrusion 16*f* toward the inner periphery of the peripheral wall 15*b* through the guide protrusion 16*i*. Further, in this embodiment, a stepped rib 15*g*, which protrudes inwardly in the radial direction, is formed integrally with the peripheral wall 15*b* of the casing 15 opposite to the bottom surface 15*a* of the casing 15 in close proximity to the guide protrusion 16*i*. In this way, a labyrinth structure is formed by the guide protrusion 16*i* and the stepped rib 15*g*, thereby making it possible to further improve the water-proof capability against intrusion to the worm wheel gear 16*b* of water entering from the inclined surface 16*g* of the worm wheel into the casing peripheral wall 15*b* through the guide protrusion 16*i*.

It should be noted that any of the structures of the second and third embodiments may be employed as the third water-proof feature in a fourth embodiment shown below, and may be selected as required.

Figure 12:
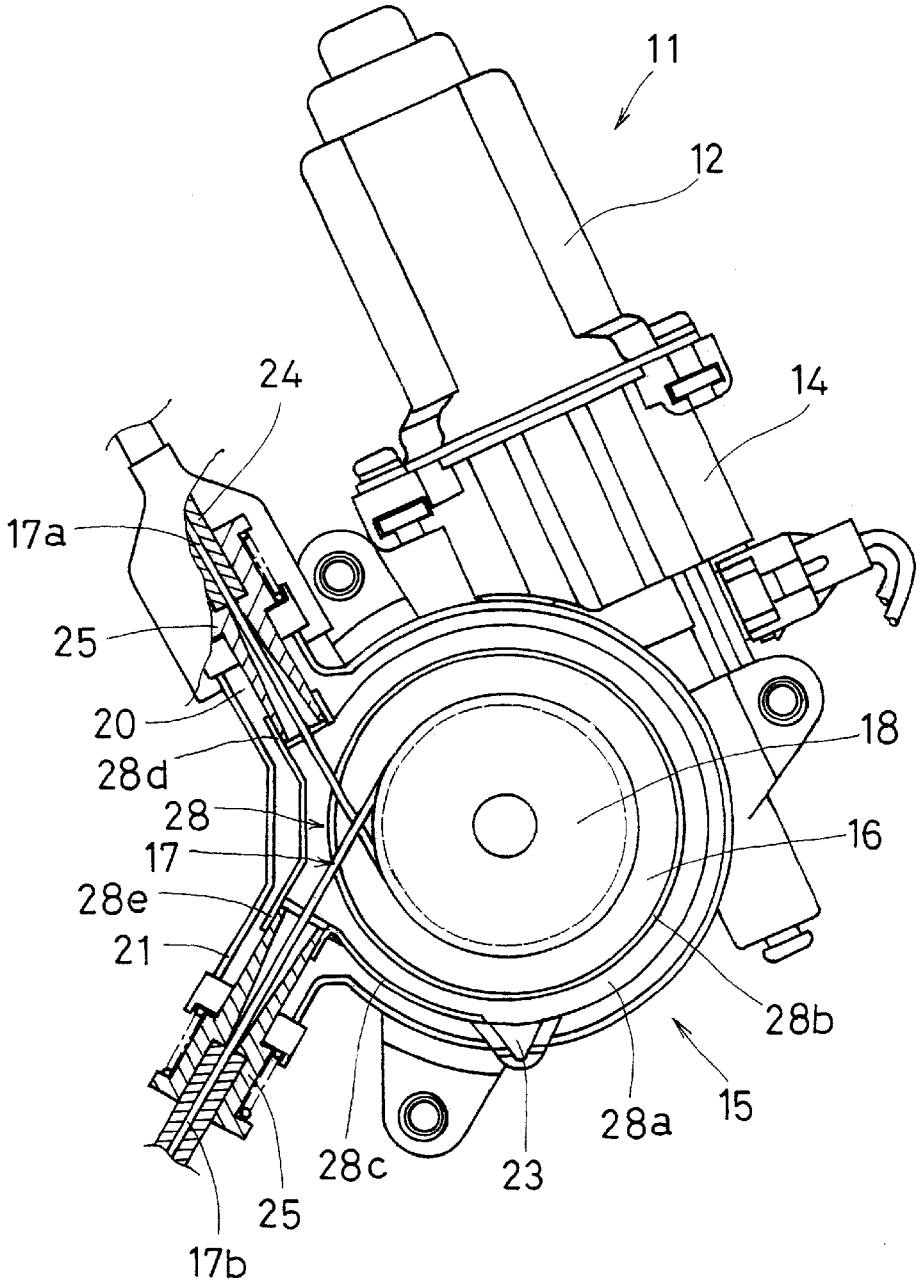
FIG. 12 is a partially sectioned front view of a cable driving device according to a fourth embodiment from which a cover has been removed.
Figure 13:
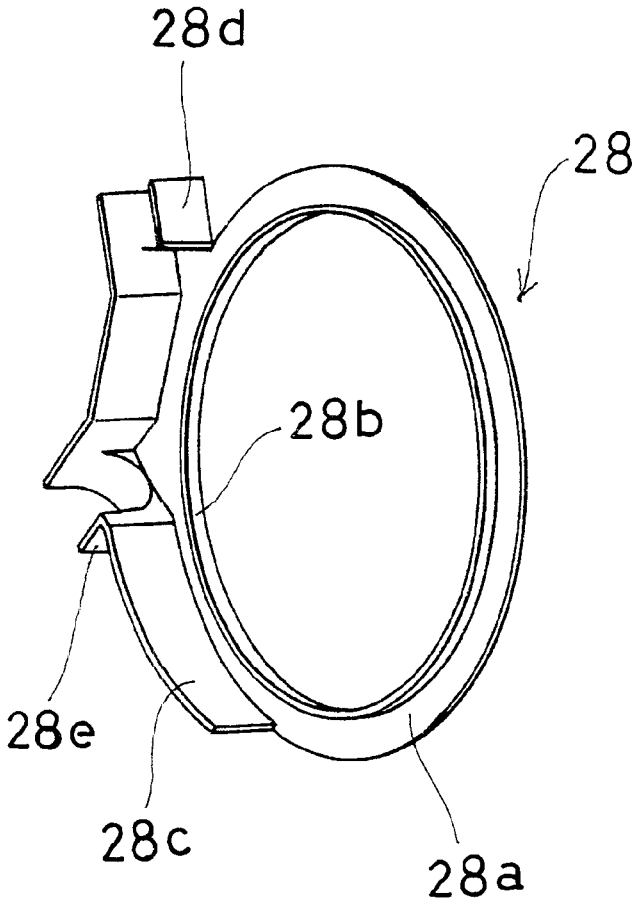
FIG. 13 is a perspective view of a conduit trough according to the fourth embodiment.
Figure 14:
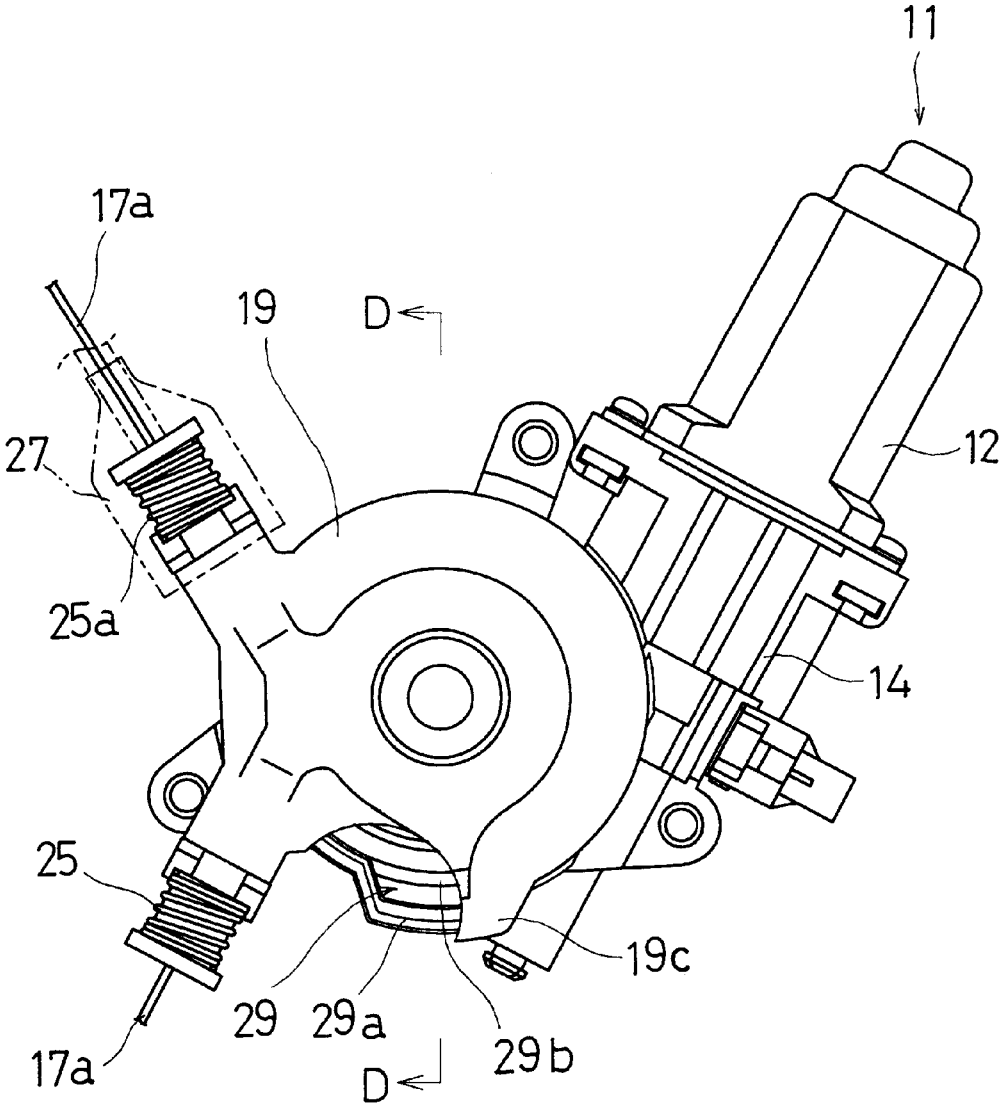
FIG. 14 is a partially cut-away front view of a cable driving device according to a fifth embodiment from which a cover has been removed.
Figure 15:
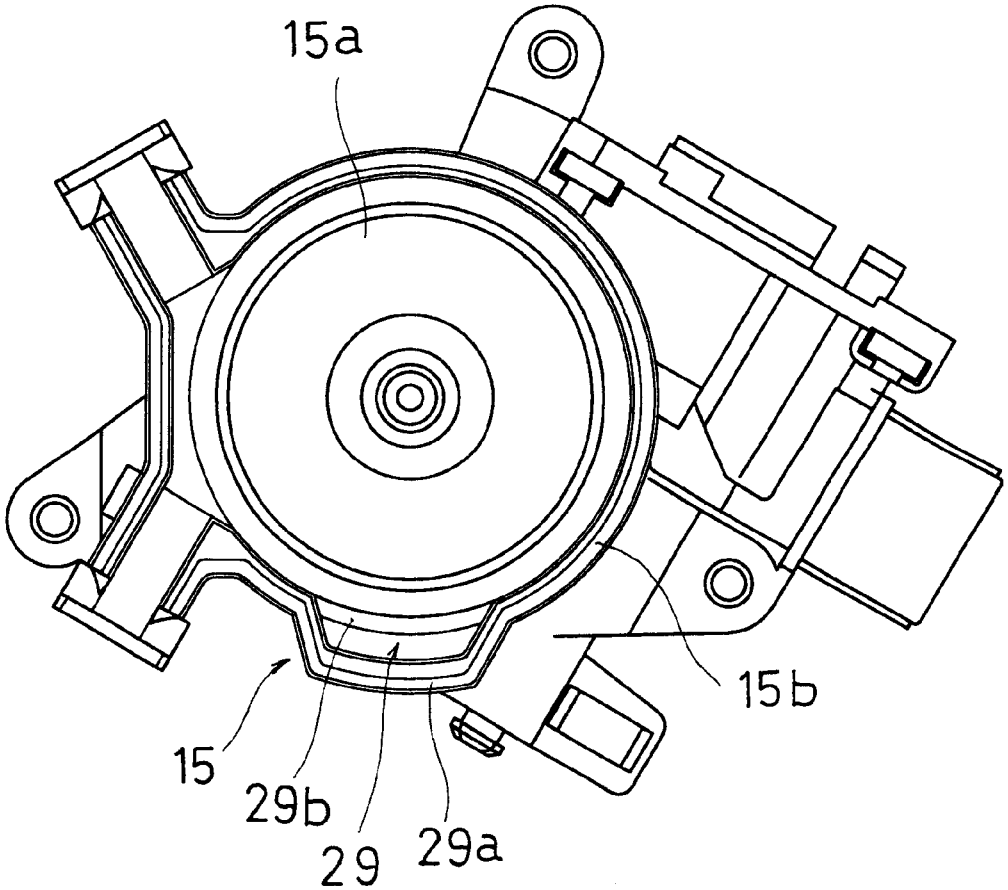
FIG. 15 is a front view of a casing of the fifth embodiment.
Figure 16:
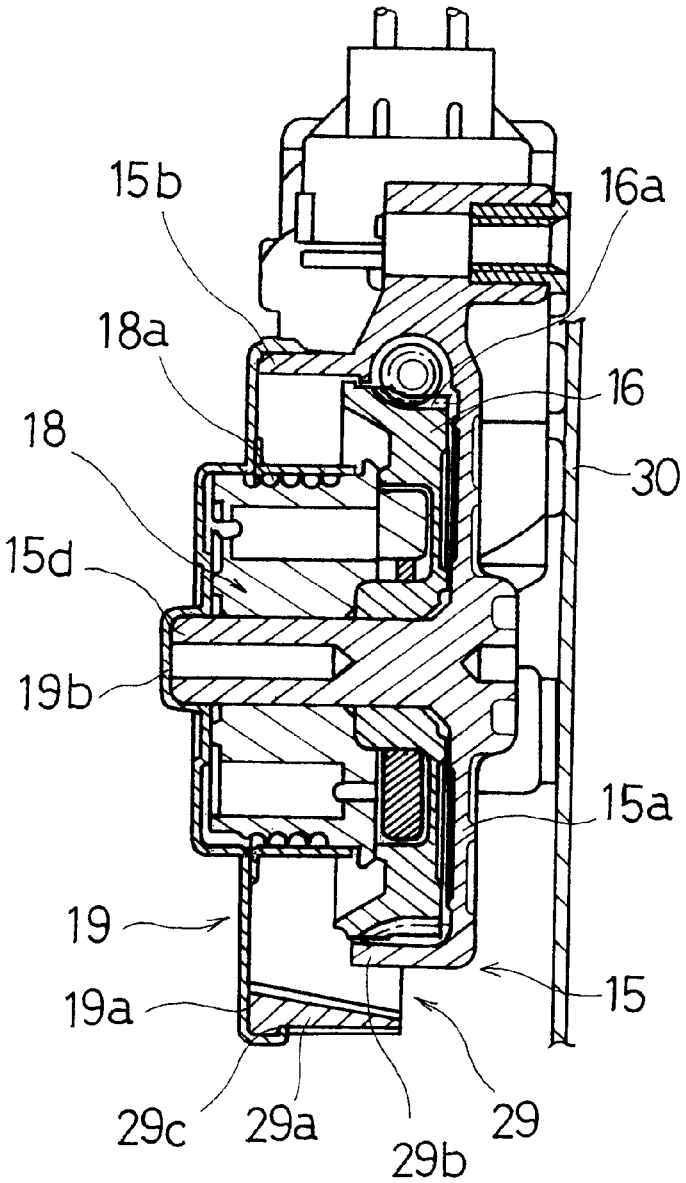
FIG. 16 is a cross-sectional view taken along the line D—D of the cable driving device of the fifth embodiment.
Figure 17:
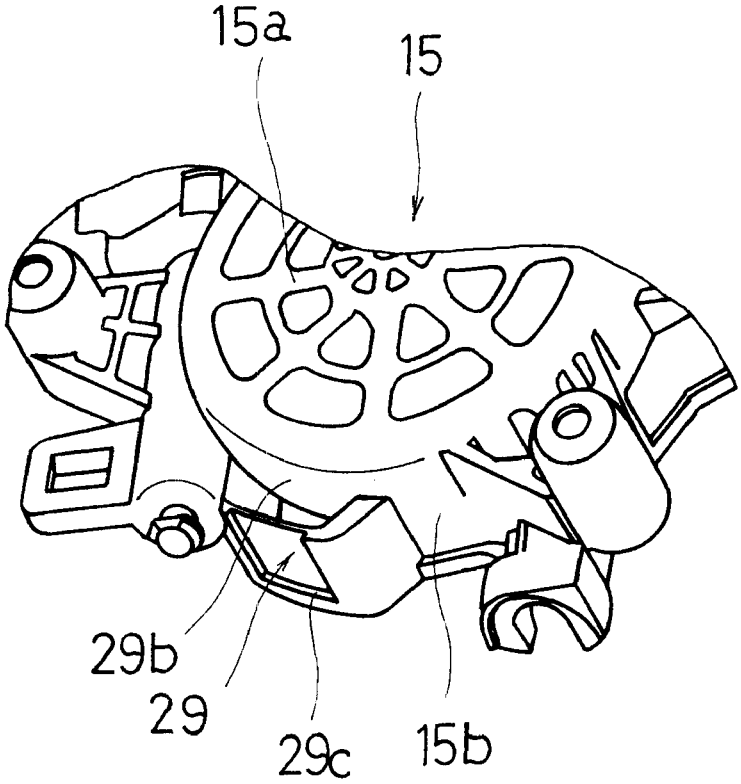
FIG. 17 is a partially cut-away perspective view seen from the back side of the bottom of a casing in the fifth embodiment.
Figure 18:
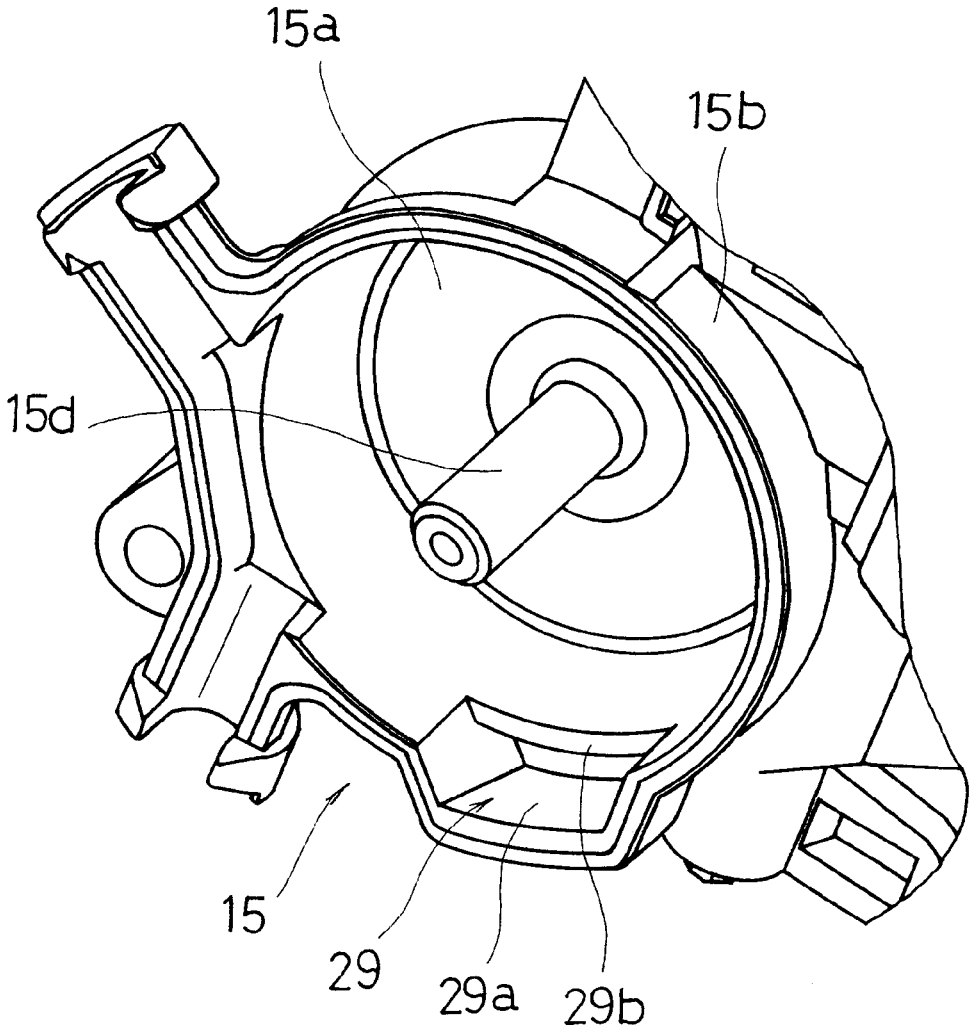
FIG. 18 is a partially cut-away perspective view seen from the upper front side of the casing in the fifth embodiment.
Figure 19:
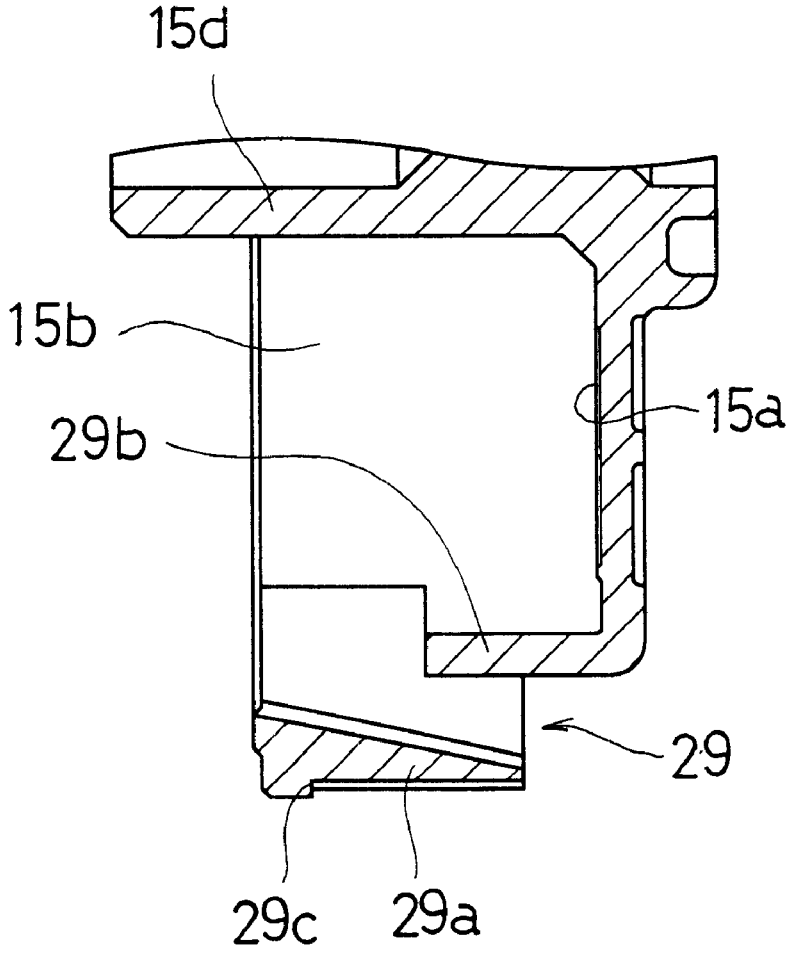
FIG. 19 is an enlarged cross-sectional view of a drain port of the fifth embodiment.

Next, the fourth embodiment will be described with reference to FIGS. 12 and 13. In the fourth embodiment, a conduit trough 28 comprises an outer leg piece 28*c* and connector pieces 28*d*, 28*e* similar to those of the first embodiment except that the conduit trough 28 does not locally extend from the first draw-out guide 20 of the cable 17 to the drain port 23, and a bottom 28*a* and an inner leg piece 28*b* are shaped in a ring. This conduit trough 28 is also assembled by inserting the respective connector pieces 28*d*, 28*e* into the base end of a joint 25, and engaging an outside portion of the bottom 28*a* with a stepped surface 15*f* formed on a casing peripheral wall 15*b*, and placing an inside portion opposite to an outside portion of one wheel surface 16*a* of a worm wheel 16 with a gap maintained therebetween. Consequently, the conduit trough 28 overlaps with an outer peripheral portion of the worm wheel 16 on the opening side of a casing 15. In this structure, the bottom 28*a* of the conduit trough has a lower edge opposite to a drain port 23 so that water entering from first and second draw-out guides 20, 21 is guided by the conduit trough 28 to flow into the drain port 23, thus providing a first water-proof feature. Also, in the fourth embodiment, since the conduit trough 28 is an annular shape, it is superior in shape stability and also superior in stability when it is set into the casing 15. Further, the fourth embodiment avoids an increase in the number of assembled parts, simplifies the assembling operations, reduces the size of the casing 15, eliminates abrasion and power loss, and improves the reliability and efficiency of the product.

The present invention may also be implemented as in a fifth embodiment illustrated in FIGS. 14 to 18. The fifth embodiment illustrates another form of the drain port. The cable driving device of the fifth embodiment is mounted such that the bottom 15*a* of the casing opposes a room-side door panel 30, wherein the drain port 29 is formed on the door panel 30 to avoid splashing of water from the outside of the car, with the following consideration additionally taken in implementing the cable driving device according to the fifth embodiment. Specifically, in the fifth embodiment, the casing is open on the bottom side, and a labyrinth structure is employed to effectively prevent water from entering from the outside of the car. More specifically, the cylindrical peripheral wall 15*b* of the casing 15 is formed in a lower portion thereof with a lower side 29*a* of the drain port 29 protruding downwardly in the radial direction, continuous to the peripheral wall 15*b*. An edge of the lower side 29*a* on the opening side of the casing is continuous from an edge of the opening of the casing peripheral wall 15*b* without any step, and is closed with a lower extension 19*c* of a cover 19 together with the opening of the casing. On the other hand, the edge of the lower side 29*a* on the bottom side 29*a* of the casing has a length to an intermediate position in the axial direction of the gear teeth 16*a* which are offset slightly to the opening of the casing from the bottom 15*a* of the casing. An upper side 29*b* of the drain port 29 extends in a region corresponding to a lower portion of the casing peripheral wall 15*b* continuous from the bottom 15*a* of the casing in a bent form, not to a position at which the opening side of the casing is closed with the cover 19, but to a position at which the gear teeth 16*a* overlapping with the lower side 29*a* in the radial direction is closed. The upper side 29*b* is formed of a short portion of the casing peripheral wall 15*b* by cutting the casing peripheral wall 15*b* on the opening side of the casing. Thus, the drain port 29 has a labyrinth structure having the upper and lower sides 29*a*, 29*b* overlying one above the other to account for the protection of entry of the splashing water into the casing 15.

In addition, the drain port 29 thus constructed can prevent splashing water to be entered into the gear teeth 16*a* through the drain port 29 from splashing the gear teeth 16*a* as a result of the labyrinth structure in which the upper and lower sides 29*a*, 29*b* mutually overlap at the position of the gear teeth 16*a*. Reference numeral 29*c* designates a step formed outside the lower side 29*a* on which the lower extension 19*c* of the cover 19 is caulked for covering the casing opening.

What is claimed is:

1. A cable driving device, comprising:

a motor that provides a drive force;

a worm gear rotatable in association with the drive force of the motor;

a bottom cylindrically shaped casing that defines a side opening that faces the worm gear and an upper opening;

a cover that closes the upper opening of the casing;

a worm wheel disposed in the casing that meshes with the worm gear;

a drum;

cables wound around the drum; and a damper that transmits the driving force of the motor from the worm wheel to the drum in a shock-absorbing state;

wherein the casing defines drawn-out guides that each form a groove and cooperate with the upper opening to enable the cables to be drawn outwardly from the drum; and wherein the cover defines guide closures that cover the drawn-out guides.

2. The cable driving device according to claim 1, wherein said damper bodies are fitted into the cavities of said worm wheel via the upper opening of the casing, and drum tongues formed on said drum are fitted into said cavities via the upper opening of the casing, each of the drum tongues being disposed between opposing damper bodies in the direction of rotation of the worm wheel.

3. The cable driving device according to claim 1, wherein said cover defines a fitting portion that enables the drum to be loosely fitted from an end portion on a cable winding side.

4. The cable driving device according to claim 1, wherein said casing includes a bottom and a supporting shaft that extends from the bottom toward the upper opening, said worm wheel and said drum are rotatably supported on said supporting shaft, and said cover is formed with a shaft support that receives and supports a distal end of said supporting shaft.

5. The cable driving device according to claim 1, wherein said damper is accommodated within the thickness of said worm wheel, and said drum is disposed between the upper opening of the casing and the worm wheel, the damper being accommodated within the worm wheel.

6. The cable driving device according to claim 1, wherein the casing includes a casing peripheral wall that defines the draw-out guides that draw out the cables extending from said drum, and a drain port that discharges water in said casing, a conduit trough being assembled at the side of the casing that guides water, which entered into the casing from said draw-out guides, to said drain port.

7. The cable driving device according to claim 6, wherein said conduit trough is integrally formed with connector pieces that are fitted into guide holes of said draw-out guides.

8. The cable driving device according to claim 6, wherein said conduit trough has a U-shaped cross-section which is open at the same side as the upper opening of the casing, and the bottom of said conduit trough extends from the casing peripheral wall to a position at which said conduit trough overlaps with said worm wheel on the casing opening side.

9. The cable driving device according to claim 7, wherein a bottom of said conduit trough defines a ring opposing the outer periphery of said worm wheel.

10. The cable driving device according to claim 1, wherein said drum defines a collar that extends outwardly in a radial direction from an edge disposed opposite to said worm wheel that guides water at said cable drum toward a drain port to prevent the water from traveling toward said worm wheel.

11. The cable driving device according to claim 1, wherein said casing includes a casing peripheral wall that defines the draw-out guides that draw out the cables to the exterior of the casing, and a drain port that discharges water in said casing to the exterior of the casing, and said worm wheel defines a protrusion around the outer periphery thereof on the cable drum side, wherein said protrusion extends so as to oppose the outer periphery of said cable drum, and said protrusion has an inclined inner peripheral surface which has a larger diameter toward the distal end of said protrusion.

12. The cable driving device according to claim 11, wherein said protrusion defines a guide protrusion at a distal end thereof, the guide protrusion extending outwardly in a radial direction.

13. The cable driving device according to claim 11, wherein said casing peripheral wall is formed with a rib that extends inwardly in the radial direction to oppose said guide protrusion on the bottom side of said casing.

14. The cable driving device according to claim 11, wherein water-proof caps are disposed in distal ends of said draw-out guides.

15. The cable driving device according to claim 11, wherein said drain port is formed through said casing, and includes a lower side extending to the bottom of said casing in a state in which said upper opening of the casing is closed by said cover, and an upper side continuous from the bottom of said casing and extending to a length so as to overlap said lower side.

16. The cable driving device according to claim 15, wherein said upper side includes a short casing peripheral wall which extends along an edge of said casing peripheral wall on the cover side so as to terminate prior to reaching a position at which said upper side is closed by said cover, the short casing peripheral wall extending to reach a position at which said upper side overlaps said lower side.

* * * * *